United States Patent [19]

Strom

[11] 4,000,915

[45] Jan. 4, 1977

[54] CONSUMER DIARY

[75] Inventor: Leslie S. Strom, Des Plaines, Ill.

[73] Assignee: Market Research Corporation of America, Chicago, Ill.

[22] Filed: Aug. 4, 1975

[21] Appl. No.: 601,270

[52] U.S. Cl. ..... 281/31; 283/36

[51] Int. Cl.[2] ..... B42D 3/00; B42F 21/00

[58] Field of Search ..... 281/31, 29; 282/29 A, 282/29 B; 283/36, 63, 66; 40/359

[56] References Cited

UNITED STATES PATENTS

| | | | |
|---|---|---|---|
| 1,417,854 | 5/1922 | Newton | 281/31 |
| 2,647,071 | 7/1953 | Schade | 281/29 X |
| 3,236,542 | 2/1966 | Russel | 282/29 B |
| 3,839,809 | 10/1974 | Casas et al. | 281/31 |

*Primary Examiner*—Lawrence Charles
*Attorney, Agent, or Firm*—Hill, Gross, Simpson, Van Santen, Steadman, Chiara & Simpson

[57] ABSTRACT

A diary and reporting device for use particularly in surveys and researches where each member of a continuing panel reports activities, purchases, opinions or the like during repetitive unit periods of time has a folder with top and bottom covers hinged together. When opened flat an information entry sheet composed of a general data section or zone and an item data zone is exposed. The item data zone is keyed or indexed to data entry guide book pages for instructions as to what data to enter for each type of item reported. An entry index facilitates use of the guide book. All components of the folder are removable and/or replaceable, as by means of tabs or edges on each item engaging cooperating slots or pockets in the folder cover, to facilitate regular reporting and periodic changes in the survey information to be gathered.

1 Claim, 6 Drawing Figures

CONSUMER DIARY

BACKGROUND OF THE INVENTION

1. Field of the Invention

This invention relates to improvements in organization and format of a recording and reporting device for use with continuing survey panels.

2. Description of the Prior Art

Prior art materials for use in surveys where persons surveyed fill in the questionnaires themselves have employed combined question and answer booklets which are both bulky for the panelist to use and to mail and time-consuming for the surveyor to process to extract the data presented. Such booklets have required a substantial number of pages to elicit all the information required, for instance, on different products purchased by a household during a week, where each different product requires different questions to identify the different characteristics of the products purchased. Coffee, for instance, comes in different grinds, with or without caffein, and in different sizes and types of packages, while fruit juices may be pure or artificial, concentrated or non-concentrated, in any of different flavors, sweetened or not, and come in different types of containers. Questionnaire booklets for 50 or more types of products are often quite long. Other types of surveys have similar problems where the subject matter is at all complex.

Where the prior art uses separate questionnaire and answer forms, generally no structural components exhibiting predetermined spacial relation have been employed whereby entries may be located in fixed zones to minimize possible error.

SUMMARY OF THE INVENTION

In accordance with the invention, two rigidly firm covers are hinged together along one edge so that they may both lie flat when unfolded and be folded together to protect papers and other contents therebetween. One or more information entry sheets are removably engaged in an aligned stack with the inside surface of the bottom cover. Each information entry sheet has two zones, a general data zone which folds out away from the folder adjacent an item data zone which lies flat on or near the bottom cover of the folder. The item data zone has horizontal lines and vertical columns in which detailed information is recorded pertaining, for instance, to individual products purchased. The general data zone has one or more spaces for the entry of more general information, such as shopping trips or household changes. The general and item data is keyed or coded to one another.

Some or all of the data to be entered on the item data zone of the information entry sheets is requested in compact form by means of a data entry guide book which is attached separately to one of the covers of the folder in such a manner that each page of the book indexes with the columns on the item data zone of the topmost information data entry sheet. The guide book would normally have many pages, each page requesting details about the particular product or subject which is addressed on that page. Each page of the guide book has a code name or number identifying the item described on the line, and computer-codable responses are exhibited.

A data entry index is conveniently provided adjacent the data entry guide book inside one of the folder covers to speed the panelist's search for products or information or subjects to be described in the report. Products or other subject matter are indexed in any convenient grouping or set of groupings.

Finally, a supply of envelopes are provided within the folder for the convenience of the panelist in dispatching his regular reports. Each completed information entry sheet can be folded to a size to fit into the envelope and then dispatched to the surveyor's processing center.

The folder may conveniently be constructed of cardboard sandwiched between plastic sheets which then may form the hinge between the top and the bottom cover, and the inside sheets may be slit as necessary to form holding tabs or slots for the entry sheets, guide book, index, and envelopes.

DESCRIPTION OF THE PREFERRED EMBODIMENT

Figure 2:
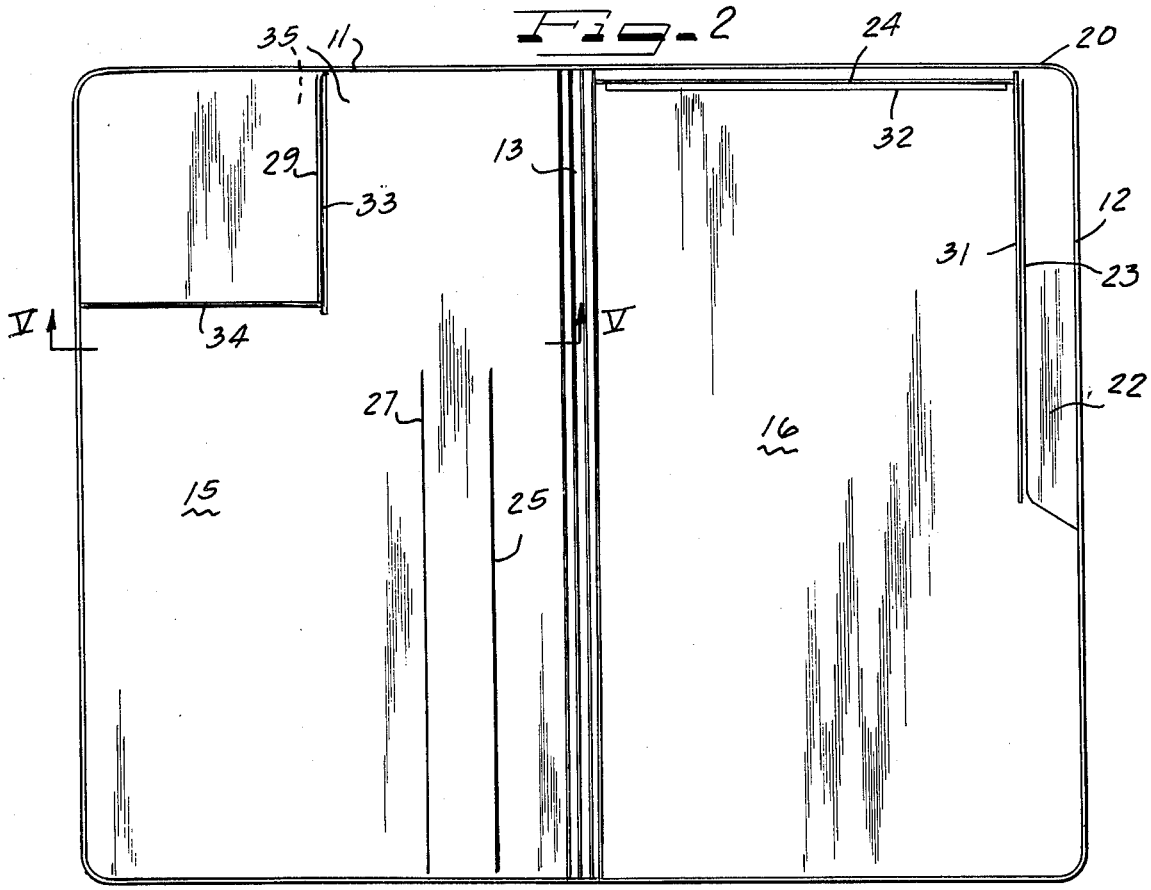
FIG. 2 is a view of the inside of the covers of the folder of the preferred embodiment of the invention, without contents.

Referring to the drawings, a diary and reporting device comprises a folder 10 which has a top cover 11 and a bottom cover 12 hinged together by a hinge section 13. Each cover is generally rectangular having upper and lower edges and side edges. The top cover 11 has an outer surface 14 and an inner surface 15, and the bottom cover 12 has an inner surface 16 and an outer surface 17. The hinge 13 allows the covers 11 and 12 to be folded substantially flat together or to be folded apart and laid flat on a surface as in FIG. 2 or FIG. 5.

Figures 4, 5, 6:
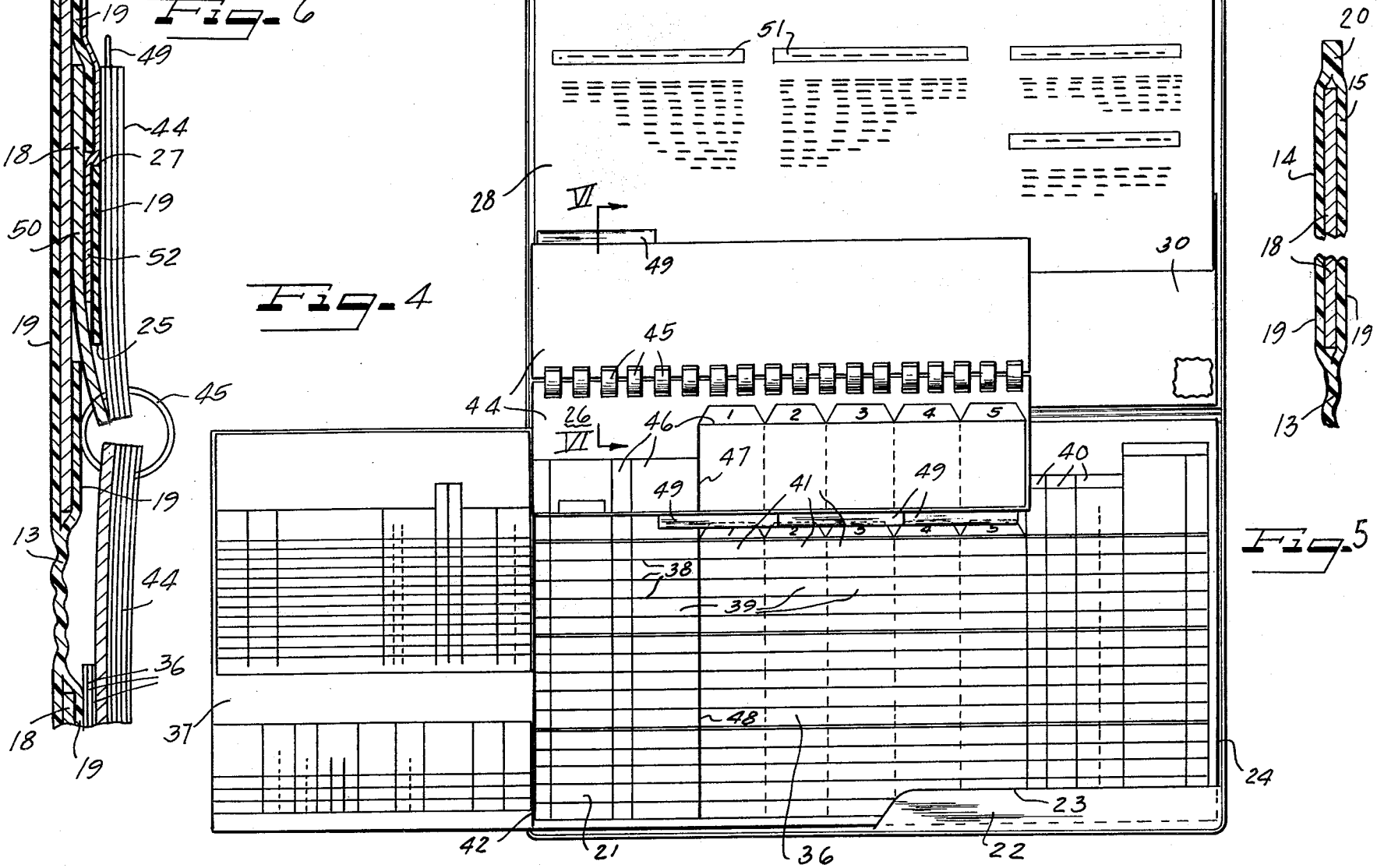
FIG. 4 shows an open folder filled with necessary materials in proper position for logging of a survey response.
FIG. 5 shows a cross-section of the empty folder covers along lines V—V of FIG. 2.
FIG. 6 shows in cross-section a view through the data entry guide book, the index sheet, and the folder cover along line VI—VI of FIG. 3.

FIG. 5 shows generally a construction of the folder 10. Each of the covers 11 and 12 has a cardboard sheet 18 enclosed within a plastic sheet 19 which may be bonded around the edges 20 of the covers and fused together between the covers 11 and 12 to form the hinge section 13.

In order to provide retention means for papers to be placed within the folder, the inner sheets 15 and 16 of the covers 11 and 12 respectively may be slit and embossed. For example, information entry sheets 21 may be retained within the folder by a tab 22 formed by a slit 23 formed in and parallel to one edge of the inside bottom sheet 16 and by a slit and raised portion 24 formed parallel to a second edge of the inner surface of the inside bottom sheet 16. The tab 22 terminates approximately half way along its edge of the cover 12.

On the opposite or top cover 11, two parallel slits 25 and 27 are made through the inside top sheet 15 above the hinge joint 13. The slit 25 closer to the hinge 13 receives and retains one cover of a data entry guide book 26. The other slit 27 receives and retains a tab 52 from a data entry index 28.

A final slit 29 is formed through the inside top sheet 15 to receive and retain envelopes 30. The plastic sheet 19 may be embossed or otherwise strengthened as at 31, 32, 33, and 34, adjacent the slits 23, 24, and 29 and in the envelope storage area, respectively.

The contents of the diary and reporting device or folder 10 include the aforementioned information entry sheets 21, data entry book 26, data entry index 28, and postal envelopes 30. Each information entry sheet has two zones, an item data zone 36 and a general zone 37. In the embodiment shown, the item data zone 36 comprises a number of horizontal lines 38 and a number of vertical lines dividing the zone into columns 39. Headings 40 may be provided for columns 39 where information sought is common to all the subject matters surveyed, such as quantity, weight or size, price, and price discounts, for product surveys.

Other columns 41 may be provided without headings printed on the information entry sheet; instructions for making entries in the columns are then given in the data entry guide book 26.

The general data zone 37 of the information entry sheet 21 may consist of one or more tables of horizontal and vertical lines in which general information is provided, such as shopping trips and changes in the household during the reporting period. The general data zone portion 37 may conveniently be attached to the item data zone portion 36 of the information entry sheet 21 by a fold line 42 so that the general data zone 37 may be folded into the folder for storage. Identifying information may then be provided on the opposite side 43 of the folded information entry sheet 21, giving, for example, the panelist's name and address and the reporting period.

Each information entry sheet 21 is removed separately from the folder 10 at the end of its respective reporting period, and folded into an envelope 30 and mailed to the survey organization. The information entry sheets 21 and envelopes 30 may conveniently be provided to each panelist periodically, and extra sheets kept in a stack beneath the tab 22 on the inner surface 16 of the bottom cover 12 and extra envelopes stacked in the storage zone 35.

The data entry guide book 26 comprises a number of pages 44 bound together along one edge with wire, plastic, or other suitable binding means 45 so as to allow all pages to lie flat in the open position. Moreover, each page 44 has a corresponding series of openings engaged by the binding means 45 and locked in a predetermined aligned position in the folder 10. Each page 44 has a number of columns 46 which are in register with corresponding columns 39 in the item data zone on the topmost information sheet. A heavy line 47 on each page 44 of the data entry guide book registers with a corresponding heavy line 48 in the item data zone on each information entry sheet when the columns are properly aligned. To emphasize the pre-alignment of the component parts the lines 47 and 48 may be colored with some contrasting color such as red to emphasize the registry provision. Any selected number of pages 44 may be provided in the data entry guide book 26, each page corresponding to a distinct subject matter such as a product group, for example, "toaster products" or "potatoes and potato dishes". Product groups or other subject matters may be further grouped in the pages 44 indexed into broader groups by means of thumb tabs 49.

The data entry guide book 26 is removably engaged with a cover of the diary and reporting device folder 10 by inserting one cover 50 of the guide book 26 under the slit 25 through the plastic sheet 15 and adjacent the cardboard sheet 18 in the top cover 11, as shown in FIG. 6.

The data entry index 28 is conveniently located adjacent the inner surface 15 of the top cover 11 of the folder, above the flip-over pages of the data entry guide book 26. The data entry index organizes the products or other subject matter within the data entry guide book and specifies the page number within the book on which instructions for that item appear. The index may be a single index for all items covered in the guide book or it may be subdivided into separate groups 51 corresponding to the groupings of the data entry guide book tabs 49. The data entry index sheet 28 has a tab 52 which is inserted into the slot 27 in the plastic sheet 15 forming the inner surface of the top cover 11. As shown in FIG. 6, the tab 52 in its installed position will lie between the cover 50 of the data entry guide book 26 and the underside of a portion of the plastic sheet 19.

The diary and reporting device or folder also includes a stack of envelopes 30 in a storage zone 35 defined by the slit 29, the embossments 33 and 34, and the inner surface 15 of the top cover 11 adjacent the data entry guide book 26. A number of pre-addressed and/or pre-stamped envelopes 30 of a size suitable for returning completed and folded information entry sheets 21 to the survey operator may be provided as shown for the convenience of the panelists.

Figure 1:
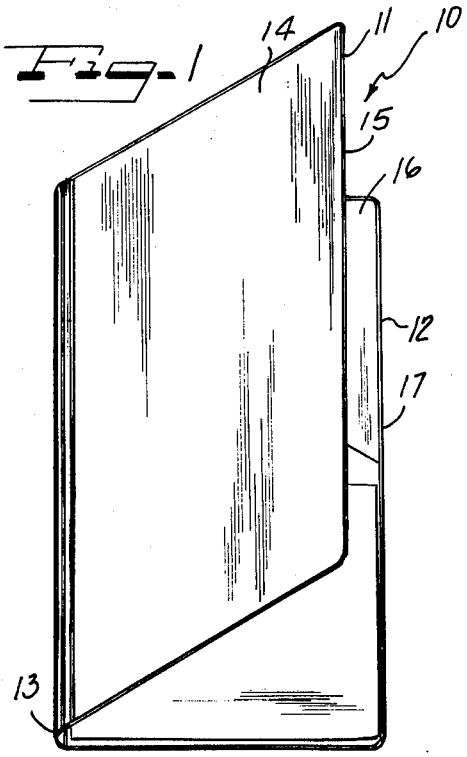
FIG. 1 shows in general view a partly opened folder as disclosed herein.
Figure 3:
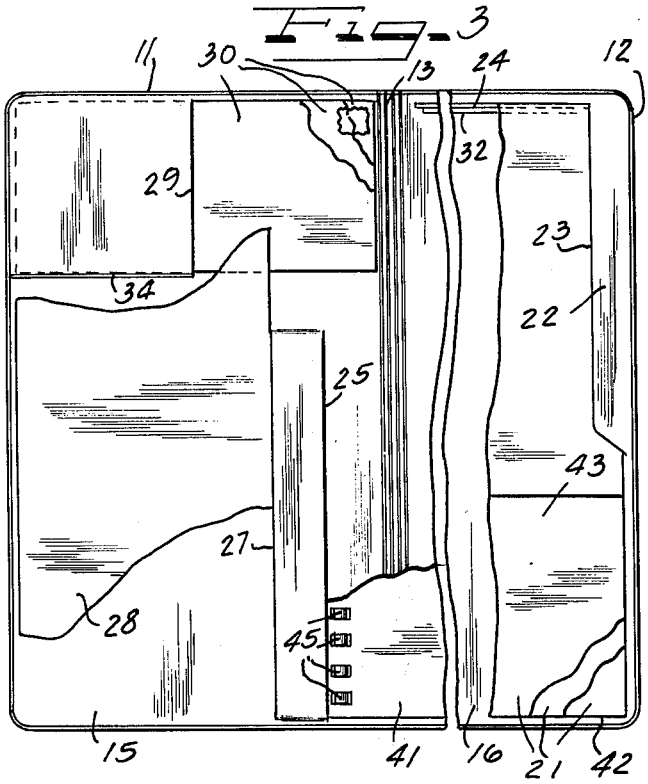
FIG. 3 is a view of the inside of the folder corresponding to FIG. 2 but with survey contents shown partially in cut-away to show the overlapping of the contents.

When the diary and reporting device is not in use, the general data zone portion 37 of the topmost information entry sheet 21 is folded over the left-hand portion of the item data zone 36, as shown in FIG. 3, and the covers 11 and 12 of the folder are hinged together as shown in FIG. 1. When a panelist has a shopping trip or other event to be recorded in the diary, he or she will open the covers of the folder, lay the covers flat, and unfold the general data zone 37 along fold line 42 away from the face of the item data zone 36. The panelist will enter any general data required in the general data zone 37. The data entry index is consulted to determine what entries are to be made in the item data zone 36. If an entry is to be made, the proper page of the entry guide book 26 as shown in the data entry index 28 will be turned uppermost in the book. The heavy registration line 47 on the page 44 of the data entry guide book 26 will be aligned with the corresponding heavy line 48 on the item data zone portion 36 of the information entry sheet 21. The panelist then makes entries on the first free line 38 from the top on the item data zone 36 as instructed by the headings 46 on the appropriate page 44 of the data entry guide book 26. Other information requested by column headings 40 on the item data zone 36 which are uniform to all entries are also provided to the right of the data entry guide book 26.

At the end of each reporting period and after all entries have been made, the panelist will remove the uppermost information entry sheet 21 from the tab 22 on the inner surface 16 of the bottom cover 12, fold the information entry sheet 21 to fit into a mailing envelope 30 removed from the envelope storage zone 35 in the folder, and mail the envelope 30 to the survey organization. A fresh information entry sheet 21 will be exposed when the uppermost sheet is removed from the tab 22, or a new entry sheet may be inserted when provided by the survey organization. In the normal course of events, monthly or other periodic supplies of information entry sheets and envelopes would be provided to each panelist for recording and reporting of survey information. The data entry guide book 26 and the data entry index 28 may be revised and replaced quarterly, semi-annually, or at such other period as meets the needs of the survey organization. Replacement of the several contents of the folder is simple and may readily be effected by individual panelists.

Although various modifications might be suggest by those versed in the art, it should be understood that I wish to embody within the scope of the patent warranted hereon all such modifications as reasonably and properly come within the scope of my contribution to the art.

I claim as my invention:

1. A survey diary and reporting folder comprising, first and second rigidly firm covers hinged together along one edge so that they may both lie flat when unfolded and may be folded into overlying adjacency to protect the contents thereof when closed, each said cover being generally rectangular and having upper, lower and side edges and inner and outer surfaces, each said cover comprising a stiff inner backing member enclosed by inside and outside sheet-form members bonded together at the outside edges and fused together between the respective covers to form a hinge section, a tab formed by a slit parallel to and spaced inwardly of the lower edge of said first cover on said inside sheet-form member, said tab terminating approximately one-half of the length of the adjacent cover edge, a pair of spaced apart parallel slits formed in said inside sheet-form member of said second cover inwardly of the hinge section and extending approximately three-quarters of the length of said cover, a separate slit formed through the inside sheet-form member of said second cover extending approximately the remaining one-quarter length thereof and spaced inwardly of the upper and lower edges to form the opening of a pouch, a plurality of rectangular information entry sheets inserted and retained in said folder behind said tab and being supported by said first cover, a data entry index sheet of L-shaped configuration having one leg of the L inserted into the innermost slit of said spaced apart parallel slits in said second cover, a plurality of postage envelopes inserted into said opening of said pouch, and a data entry book comprising a rigid backing sheet inserted into the outermost slit of said spaced apart parallel slits in said second cover, said data entry book comprising a ring binder connected to said rigid backing sheet and disposed to overlie the hinge section, and a plurality of plural page groups, each page group separated by a separate index page bearing a thumb tab projecting outwardly of the edges of the pages, thereby to provide flip-over pages to selectively overlie said entry sheets, each of said rectangular information entry sheets having a first general data zone which folds outwardly away from the folder and an item data zone divided into horizontal lines and vertical columns, each page of said data entry book having indexed columns aligned with corresponding columns on the item data zone of the topmost information data entry sheet, each said entry sheet and each said page having a key register to insure accurate pre-alignment, said data entry index constituting an index to the products in the data entry book, whereby entries made by a user in the field and requested by the data entry book may be entered on the topmost entry sheet for subsequent posting of the entry sheet to a remote data compilation center.

* * * * *